US005875856A

United States Patent [19]

Gustavsson

[11] Patent Number: 5,875,856

[45] Date of Patent: Mar. 2, 1999

[54] THROTTLE FOR A MOTOR DRIVEN HAMMER MECHANISM

[75] Inventor: Magnus Gustavsson, Nybro, Sweden

[73] Assignee: Atlas Copco Berema AB, Nacka, Sweden

[21] Appl. No.: 930,397

[22] PCT Filed: Mar. 18, 1996

[86] PCT No.: PCT/SE96/00337

§ 371 Date: Sep. 30, 1997

§ 102(e) Date: Sep. 30, 1997

[87] PCT Pub. No.: WO96/32229

PCT Pub. Date: Oct. 17, 1996

[30] Foreign Application Priority Data

Apr. 11, 1995 [SE] Sweden ..... 9501340

[51] Int. Cl.[6] ..... B25D 17/04

[52] U.S. Cl. ..... 173/170; 173/168

[58] Field of Search ..... 173/168, 169, 173/170, 15

[56] References Cited

U.S. PATENT DOCUMENTS

| | | | |
|---|---|---|---|
| 1,809,141 | 6/1931 | Mock . | |
| 2,138,915 | 12/1938 | Fuehrer . | |
| 2,349,401 | 5/1944 | Beckwith | 173/170 |
| 2,350,680 | 6/1944 | Heintz | 173/170 |
| 3,386,298 | 6/1968 | Klinger | 173/170 |
| 3,666,027 | 5/1972 | Sauerwein et al. | 173/169 |
| 3,718,313 | 2/1973 | Miller | 173/169 |
| 3,844,360 | 10/1974 | Green et al. | 173/170 |
| 5,163,354 | 11/1992 | Bilodeau | 173/170 |
| 5,749,421 | 5/1998 | Johannson et al. | 173/170 |

*Primary Examiner*—Scott A. Smith
*Attorney, Agent, or Firm*—Mark P. Stone

[57] ABSTRACT

A throttle for a motor driven hammer mechanism has a handle (2) connected to a machine housing (1), a first lever (3) swingably connected to the handle, a second lever (6) swingably connected to the first lever, and a spring (7) arranged between the two levers and a transfer device (4) for transferring the movement of the levers to an operating arm (15) on a speed regulator arranged in the hammer mechanism.

9 Claims, 2 Drawing Sheets

THROTTLE FOR A MOTOR DRIVEN HAMMER MECHANISM

BACKGROUND OF THE INVENTION

The present invention relates to a throttle for a motor driven hammer mechanism. More particularly the invention relates to a throttle which allows a simple control of the rotational speed of the motor during collaring.

In prior art motor driven hammer mechanisms one has used a lever connected with one of the handles for controlling the rotational speed of the motor. This solution works well during drilling when one works with full motor speed. During collaring, when one works with reduced speed, the prior art throttle is uncomfortable because the lever should be partly pressed down at the same time as the drilling machine should be guided relative to the surface to be worked on.

SUMMARY OF THE INVENTION

The present invention, which is defined in the subsequent claims, aims at achieving a throttle where the above mentioned drawbacks have been eliminated through introduction of an extra lever for reducing the rotational speed of the motor during collaring. Because of this the operator can hold the hammer mechanism in a firm grip for guiding the hammer mechanism efficiently and comfortably over the surface to be worked on.

BRIEF DESCRIPTION OF DRAWINGS

An embodiment of the invention is described below with reference to the accompanying drawings in which.

DESCRIPTION OF THE BEST MODES FOR CARRYING OUT THE INVENTION

Figure 1:
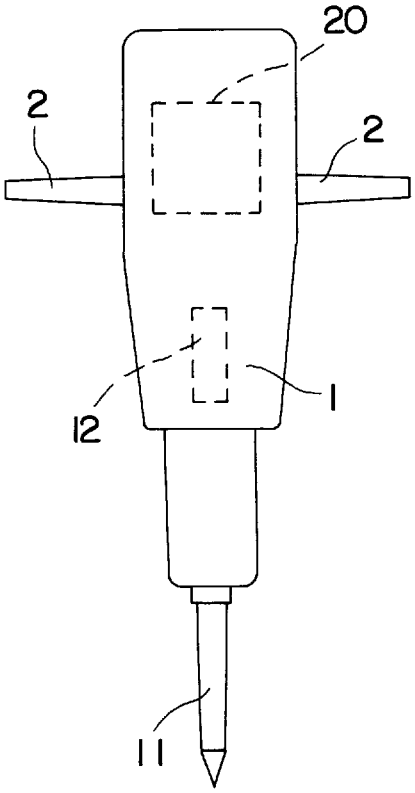
FIG. 1 shows a schematic view of a hammer mechanism according to the invention.

The hammer mechanism shown in the drawings, which can be a drilling machine and/or a pavement breaker, comprises a machine housing 1 on which two handles 2 are arranged for the handling of the machine. A tool 11 is inserted into the machine. During operation a hammer piston 12 arranged for movement to-and-fro in the hammer mechanism hits the tool. In one of the handles 2 a throttle is arranged. The throttle comprises a first lever 3 which through a link 13 is swingably connected to the handle 2. A second lever 6 is through a link 16 swingably connected to the first lever 3.

Between the levers a spring 7 is arranged to keep the levers apart. Through this the second lever 6 is swung toward an end position relative to the first lever 3. This end position is defined by a stop 31 on the first lever 3. A transfer device 4 in form of a flexible sleeve and a cable 14 arranged therein is arranged to transfer the movement of the second lever to an operating arm 15 of a speed regulator 5 associated with a motor 20 provided in the machine housing 1. The motor can be a combustion engine. an electric motor. a hydraulic motor or some other suitable motor. The sleeve is at one end connected with the second lever 6 and at the other end with a bracket 19 in the machine housing. The cable 14 is at one end connected with the handle 2 and at the other end with the operating arm 15 on the speed regulator 5. Cable and sleeve can, of course, be arranged the other way round, i.e. the cable 14 can be connected to the second lever 6 and the sleeve to the handle 2. An adjusting screw 8 is arranged on the second lever 6 for adjustment of the maximum swing of the second lever 6 relative to the first lever 3. This swing occurs about the link 16 against the action of the spring 7.

Figure 2:
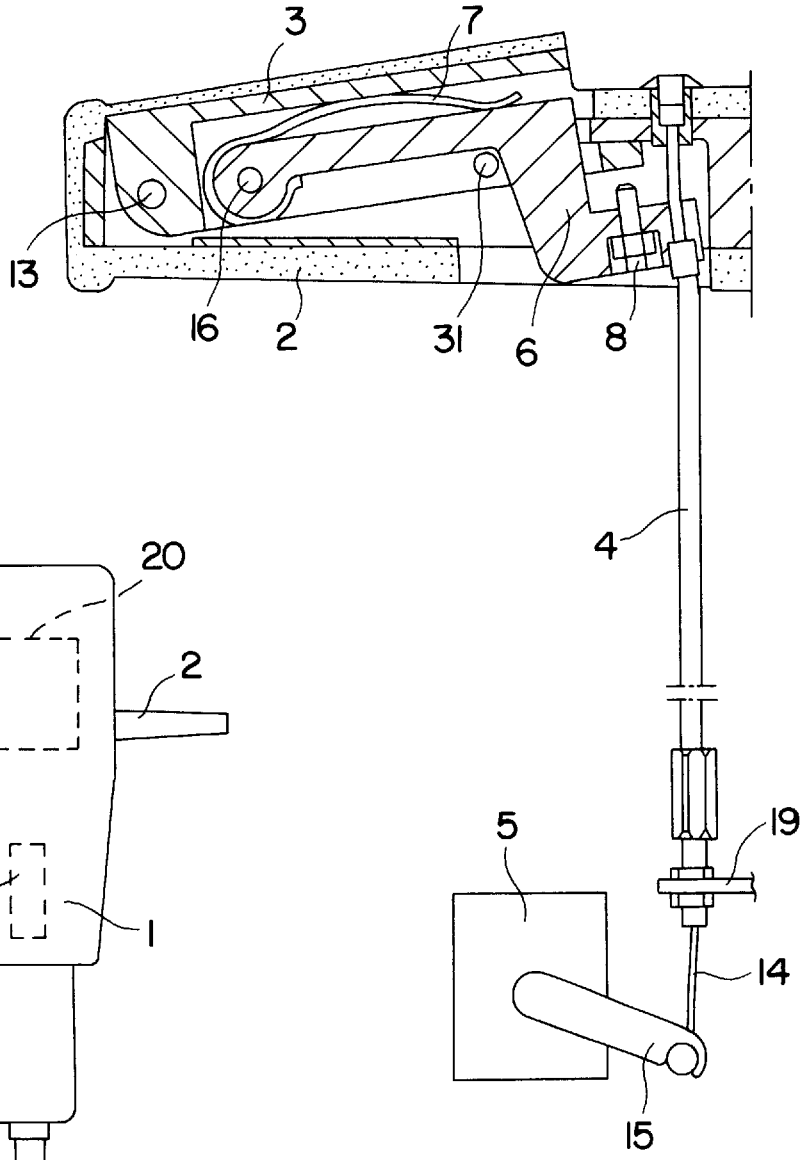
FIG. 2 shows a section through one of the handles on the hammer mechanism with the throttle in idle position.
Figure 3:
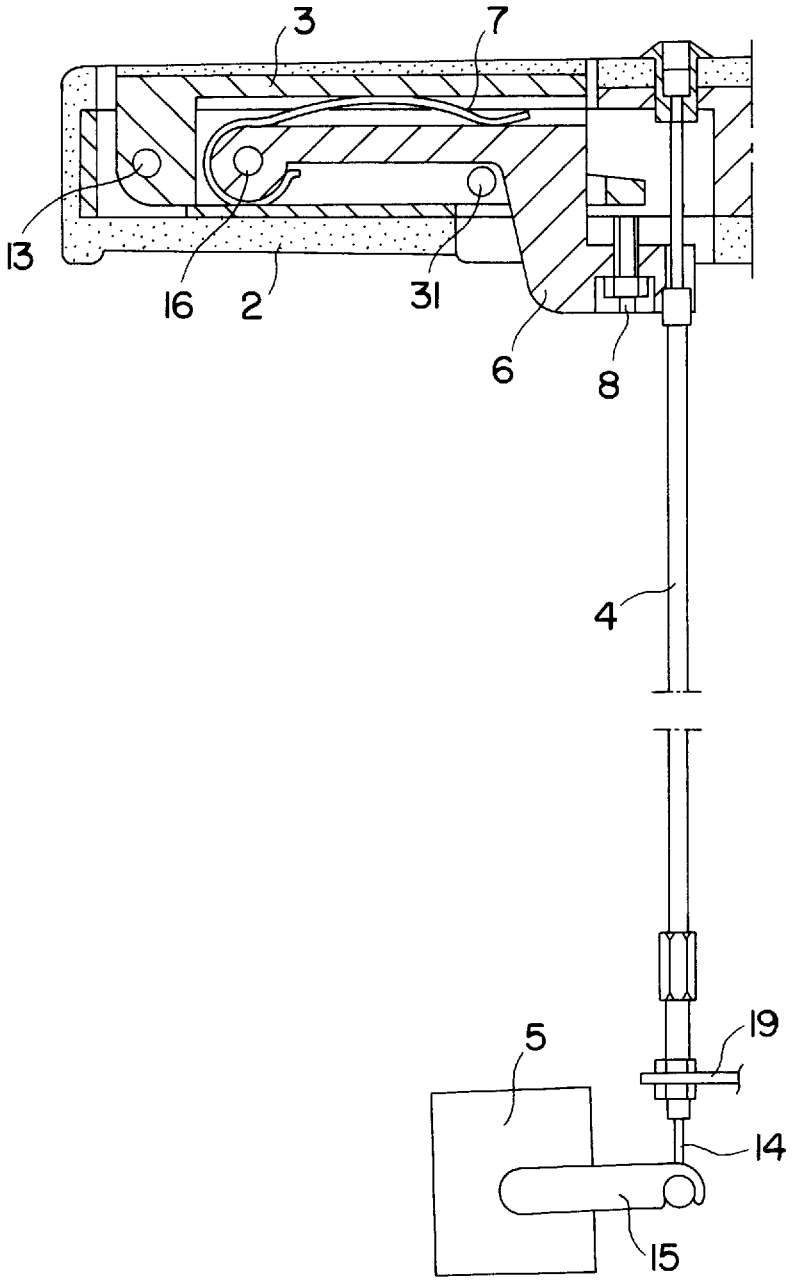
FIG. 3 shows a section through the handle with the throttle in full speed position.

With the levers in the positions shown in FIG. 2 the motor idles. In the positions shown in FIG. 3 the motor is operating at full speed. Through pressing down the second lever 6 toward the first lever 3 against the action of the spring 7 the speed of the motor is decreased to a speed suitable for collaring. The rotational speed for collaring is adjusted with the adjusting screw 8. With the throttle according to the invention one can have the first lever completely pressed down during collaring which makes it substantially easier to guide the machine during collaring.

I claim:

1. Throttle for a motor driven hammer mechanism comprising a handle (2) connected to a machine housing (1), a first lever (3) swingably coupled to said handle, and a transfer device (4) coupled to said first lever for transferring movement of the position of said first lever to a speed regulator (5) for controlling the speed of the motor, wherein a second lever (6) is disposed between said first lever and said transfer device for swingably coupling said first lever to said transfer device, said transfer device (4) being coupled to said second lever (6) for transferring movement of the position of said second lever to said speed regulator for controlling the speed of the motor independent of said first lever, and a resilient element (7) is arranged between said first (3) and second (6) levers for swinging said second lever (6) toward an end position (31) relative to said first lever (3).

2. Throttle according to claim 1, comprising adjusting means (8) for adjusting the maximum swing of said second lever (6) relative to said first lever (3).

3. Throttle according to claim 2, wherein said adjusting means comprises an adjusting screw (8) arranged on said second lever (6).

4. Throttle according to claim 1, wherein said resilient element comprises a spring.

5. Throttle according to claim 1, wherein said end position (31) is a stop element defined on said first lever (3).

6. Throttle for a motor driven hammer mechanism comprising a handle (2) connected to a machine housing (1), a first lever (3) swingably coupled to said handle, and a transfer device (4) coupled to said first lever for transferring movement of the position of said first lever to a speed regulator (5) for controlling the speed of the motor, wherein a second lever (6) is disposed between said first lever and said transfer device for swingably coupling said first lever to said transfer device, said transfer device (4) being coupled to said second lever (6) for transferring movement of the position of said second lever to said speed regulator for controlling the speed of the motor independent of said first lever, and a resilient element (7) is arranged between said first (3) and second (6) levers.

7. Throttle according to claim 6, comprising adjusting means for adjusting the maximum swing of said second lever (6) relative to said first lever (3).

8. Throttle according to claim 7, wherein said adjusting means comprises an adjusting screw (8) arranged on said second lever (6).

9. Throttle according to claim 6, wherein said resilient element comprises a spring (7).

* * * * *